US009039360B2

(12) United States Patent
Fukuda et al.

(10) Patent No.: US 9,039,360 B2
(45) Date of Patent: May 26, 2015

(54) CENTRIFUGAL FAN

(75) Inventors: Takako Fukuda, Nagano (JP); Seiya Fujimoto, Nagano (JP); Masaki Ogushi, Nagano (JP); Yuzuru Suzuki, Nagano (JP)

(73) Assignee: Minebea Co., Ltd., Nagano (JP)

( * ) Notice: Subject to any disclaimer, the term of this patent is extended or adjusted under 35 U.S.C. 154(b) by 628 days.

(21) Appl. No.: 13/357,776

(22) Filed: Jan. 25, 2012

(65) Prior Publication Data

US 2012/0195747 A1 Aug. 2, 2012

(30) Foreign Application Priority Data

Jan. 27, 2011 (JP) ..... 2011-015413

(51) Int. Cl.

| | |
|---|---|
| ***F04D 17/08*** | (2006.01) |
| ***F04D 29/08*** | (2006.01) |
| ***F04D 29/18*** | (2006.01) |
| ***F04D 29/16*** | (2006.01) |

(Continued)

(52) U.S. Cl.

CPC ..... *F04D 29/162* (2013.01); *F04D 29/083* (2013.01); *F04D 29/22* (2013.01); *F04D 29/4226* (2013.01); *F04D 29/441* (2013.01)

(58) Field of Classification Search

CPC ..... F04D 29/08; F04D 29/083; F04D 29/16; F04D 29/162; F04D 29/18; F04D 29/22; F04D 29/2216; F04D 29/40; F04D 29/42; F04D 29/4246; F04D 29/44; F04D 29/4226; F04D 29/441

USPC ..... 415/168.1, 168.2, 168.3, 170.1, 171.1, 415/172.1, 174.5, 203, 206, 224, 226; 416/174, 179, 182, 184, 185, 186 R, 416/187

See application file for complete search history.

(56) References Cited

U.S. PATENT DOCUMENTS 4,917,572 A * 4/1990 Van Houten ..... 415/206
4,946,348 A * 8/1990 Yapp ..... 415/211.2

(Continued)

FOREIGN PATENT DOCUMENTS

JP 6-063512 B 8/1994
JP 07-012093 A 1/1995

(Continued)

OTHER PUBLICATIONS

Office Action issued on Nov. 4, 2014 in the corresponding JP Patent Application 2011-015413.

*Primary Examiner* — Edward Look
*Assistant Examiner* — Christopher R Legendre
(74) *Attorney, Agent, or Firm* — Carrier Blackman & Associates, P.C.; William D. Blackman; Joseph P. Carrier

(57) ABSTRACT

A centrifugal fan is provided. The centrifugal fan is configured such that an impeller having a plurality of blades along a circumferential direction and disposed between a disk-shaped main plate and an annular shroud is housed in a casing configured by an upper casing and a lower casing, and that an air suctioned from a suction opening is discharged outward in a radial direction of the impeller by a centrifugal force due to a rotation of the impeller. The shroud has a curved surface formed from an outer edge portion toward a center thereof. The shroud has a plurality of protrusions which are formed on the surface of the shroud such that a gap is formed between each of the protrusion portions and the upper casing.

2 Claims, 8 Drawing Sheets

(51) Int. Cl.

| | |
|---|---|
| ***F04D 29/22*** | (2006.01) |
| ***F04D 29/42*** | (2006.01) |
| *F04D 29/40* | (2006.01) |
| *F04D 29/44* | (2006.01) |

(56) References Cited

U.S. PATENT DOCUMENTS

| | | | | |
|---|---|---|---|---|
| 5,352,089 | A | 10/1994 | Tokunaga et al. | |
| 5,511,939 | A | 4/1996 | Tokunaga et al. | |
| 6,551,074 | B2 * | 4/2003 | Kudo et al. | 417/354 |
| 7,476,076 | B2 * | 1/2009 | Shimada | 415/58.4 |
| 7,883,312 | B2 * | 2/2011 | Eguchi et al. | 415/119 |
| 8,834,112 | B2 * | 9/2014 | Fukuda | 415/206 |
| 2006/0198730 | A1 * | 9/2006 | Awdalla | 415/206 |
| 2012/0195747 | A1 * | 8/2012 | Fukuda et al. | 415/206 |
| 2012/0211205 | A1 * | 8/2012 | Eguchi et al. | 165/121 |

FOREIGN PATENT DOCUMENTS

| | | | | |
|---|---|---|---|---|
| JP | 10054388 | A | * | 2/1998 |
| JP | 11091334 | A | * | 4/1999 |
| JP | 2940751 | B2 | | 6/1999 |
| JP | 2004068741 | A | * | 3/2004 |
| JP | 2004092583 | A | * | 3/2004 |
| WO | WO 2011055594 | A1 | * | 5/2011 |

* cited by examiner

RELATED ART

RELATED ART

RELATED ART

CENTRIFUGAL FAN

BACKGROUND OF THE INVENTION

1. Field of the Invention

The present invention relates to a centrifugal fan, and more particularly, to a centrifugal fan which can reduce noise and improve an air flow characteristic.

2. Description of the Related Art

A centrifugal fan is configured by providing an impeller in a casing. The impeller has a plurality of blades disposed around a rotation shaft of a motor, and the casing has a suction opening and a discharge opening. Air suctioned from the suction opening flows from the center of the impeller into between the blades, and is discharged outward in the radial direction of the impeller by a fluid force due to a centrifugal action from the rotation of the impeller. The air discharged from the outer circumference of the impeller passes through the casing to become high-pressure air, and is discharged from the discharge opening.

This centrifugal fan is widely used for cooling, ventilation, and air conditioning in home appliances, OA devices, and industrial equipment, an air blower for a vehicle, and the like. However, in the centrifugal fan, the air blowing performance and noise are significantly influenced by the blade shape of the impeller and the shape of the casing. Therefore, in order to reduce noise and improve air blowing performance, the optimization of the shape of the impeller and the configuration of the casing has been attempted, and various proposals have been made. A centrifugal fan which optimizes a blade shape of an impeller to reduce noise is disclosed (for example, refer to JP-A-H06-063512).

FIG. 10 is a cross-sectional view illustrating a centrifugal fan 100 disclosed in JP-A-H06-063512, and FIG. 11 is a planar cross-sectional view of FIG. 10. An impeller 120 of the centrifugal fan 100 includes a plurality of blades 123 disposed between a main plate 121 and a sub plate 122, and an outer circumference side of the blades 123 rotates with delay from an inner circumference side of the blades 123 in a rotation direction of the impeller 120. The blades having the structure in which the outer circumference side of the blade 123 rotates with delay from the inner circumference side in the rotation direction of the impeller 120 are backward inclined blades, and have a curved blade shape inclined backward in the rotation direction. A centrifugal fan having that blade shape is generally called a turbofan. A casing 127 is attached to the impeller 120 to blow air. The air to be blown is suctioned from a suction opening 128 of the impeller 120, is discharged from the outer circumference of the impeller 120 by a fluid force due to a centrifugal action from the rotation of the blades 123 of the impeller 120, is guided to a discharge opening 129 of the casing 127 along the casing 127 surrounding the outer circumference of the impeller 120, and is discharged to an outside of the casing 127.

The centrifugal fan 100 disclosed in JP-A-H06-063512 realizes suppression of noise when air is blown by considering the shape of the blades 123. However, since there is a gap between the casing 127 and the sub plate 122 of the impeller 120, when air discharged from the outer circumference of the impeller 120 collides with the inner wall surface of the casing 127, a portion of the air flows back to the suction opening 128 so as to interfere with air suctioned into the suction opening 128 such that noise occurs.

In view of the above, there is disclosed a centrifugal fan which prevents a portion of air discharged from the outer circumference of an impeller from flowing back to a suction opening, so as to reduce noise (for example, refer to JP-B-2940751).

FIG. 12 is a cross-sectional view illustrating a portion of a centrifugal fan 200 disclosed in JP-B-2940751. The centrifugal fan 200 includes a plurality of blades 225 annularly formed in a circumferential direction of the vicinity of an outer circumferential edge of a base plate 224, and an annular shroud 226 formed at a top portion of the blades 225. The shroud 226 is formed in an arc shape so as to blow air from an air suction opening 236 outward in a radial direction. A bell-mouth inner wall 231*a* and an internal wall 222*c* of a case 222 are formed along a shape of the shroud 226 such that a gap with the shroud 226 becomes narrower. This narrow gap is formed over a relatively long distance from the inner side to the outer side in the radial direction, and an annular protrusion 226*b* of the shroud 226 prevents air from flowing back through the gap, so as to reduce noise.

The centrifugal fan 200 disclosed in JP-B-2940751 prevents air from flowing back, so as to reduce noise. However, in order to prevent the annular protrusion 226*b* of the shroud 226 from coming into contact with the bell-mouth inner wall 231*a*, it is required to have high component processing accuracy and high assembly accuracy, and thus the cost increases. Further, since a bell mouth 231 is formed, it is not possible to reduce the height dimension of the case 222, so that the centrifugal fan cannot be housed in a limited space.

SUMMARY OF THE INVENTION

The present invention has been made in view of the above circumstances, and it is an object of the present invention to provide a centrifugal fan which prevents a portion of air discharged from an outer circumference of an impeller from flowing back to a suction opening while reducing a cost and a thickness.

According to an illustrative embodiment of the present invention, there is provided a centrifugal fan configured such that an impeller having a plurality of blades along a circumferential direction and disposed between a disk-shaped main plate and an annular shroud is housed in a casing configured by an upper casing and a lower casing, and that an air suctioned from a suction opening is discharged outward in a radial direction of the impeller by a centrifugal force due to a rotation of the impeller, wherein the shroud has a curved surface formed from an outer edge portion toward a center thereof, and wherein the shroud has a plurality of protrusions which are formed on the surface of the shroud such that a gap is formed between each of the protrusion portions and the upper casing.

In the centrifugal fan, the plurality of protrusion portions may be formed annularly and concentrically.

Alternatively, in the centrifugal fan, the plurality of protrusion portions may be formed annularly and spirally.

According to the above configuration, it is possible to reduce or prevent a portion of air suctioned from the outer circumference of the impeller from flowing back to the suction opening. As a result, the suctioned air increases and thus it is possible to improve the air flow characteristic.

Further, since high accuracy is not necessarily required in component processing accuracy and assembly accuracy, it is possible to reduce the cost. Furthermore, since a bell mouth is not formed, it is possible to provide a thin centrifugal fan.

DETAILED DESCRIPTION

Figure 1:
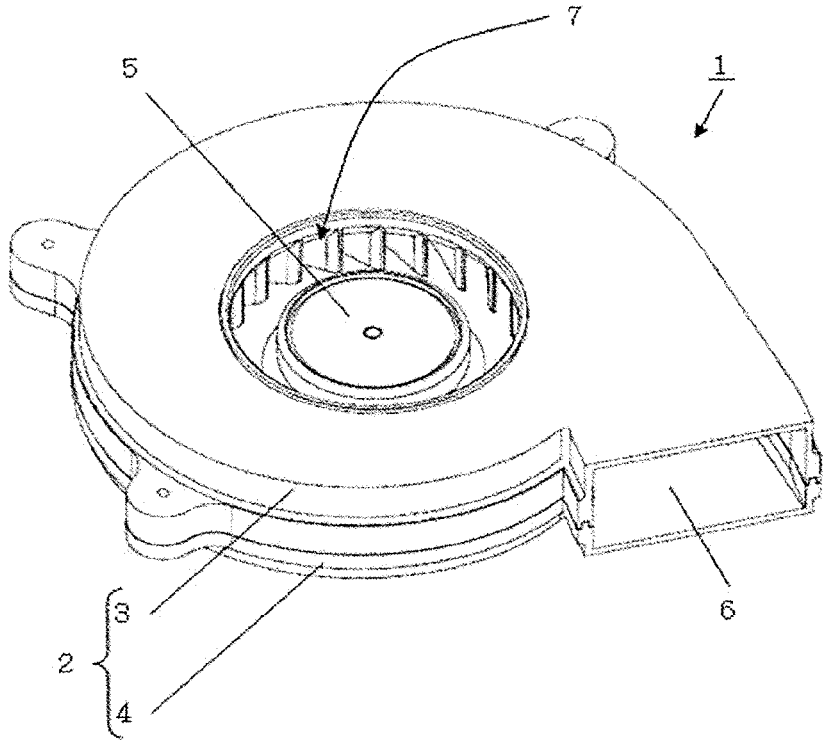
FIG. 1 is a perspective view illustrating a centrifugal fan according to an illustrative embodiment of the present invention.
Figure 2:
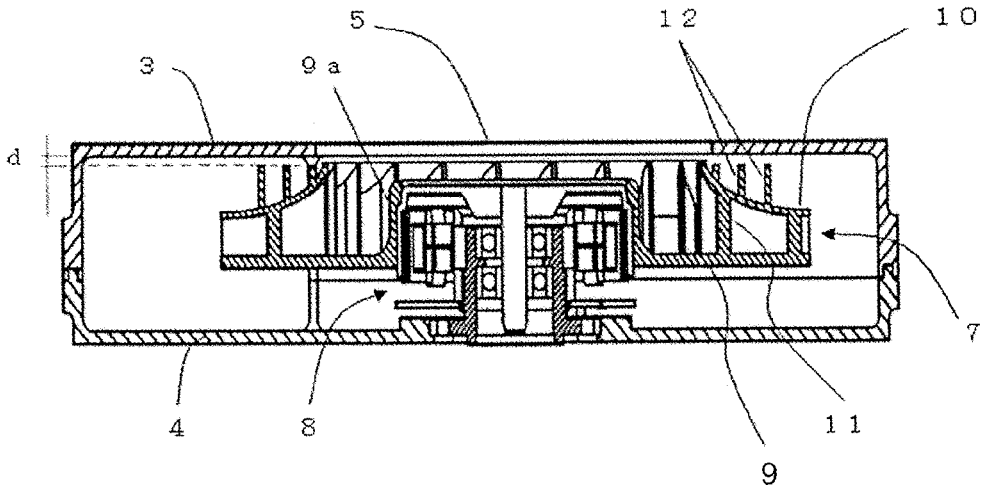
FIG. 2 is a cross-sectional view of the centrifugal fan shown in FIG. 1.
Figure 3:
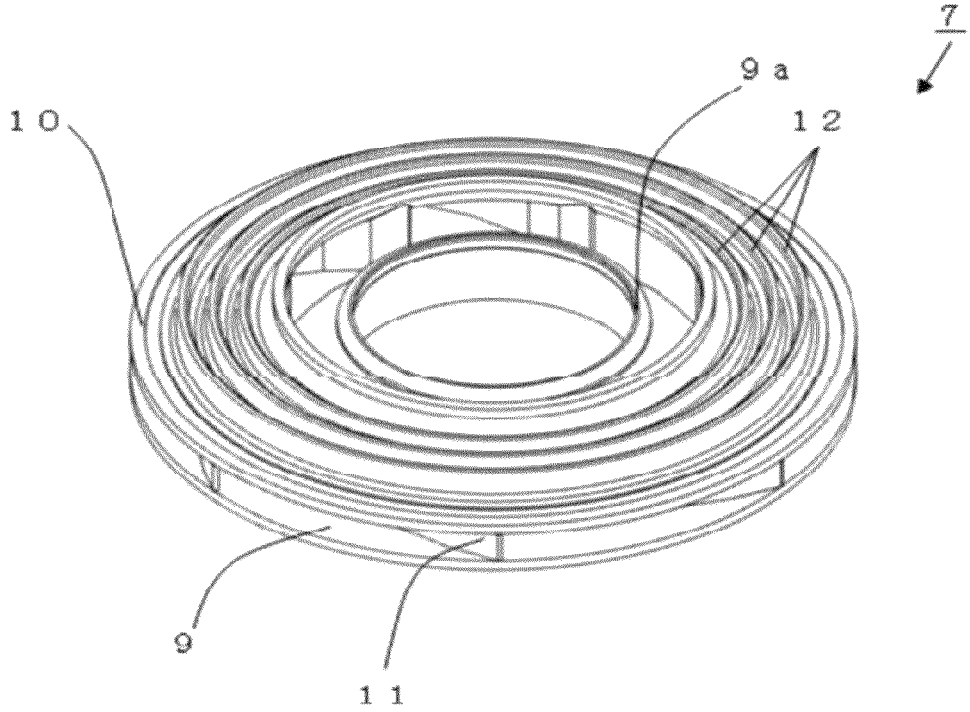
FIG. 3 is a perspective view illustrating an impeller of the centrifugal fan shown in FIG. 1.

Hereinafter, illustrative embodiments of the present invention will be described with reference to the accompanying drawings. FIG. 1 is a perspective view illustrating a centrifugal fan according to an illustrative embodiment of the present invention, FIG. 2 is a cross-sectional view of the centrifugal fan shown in FIG. 1, and FIG. 3 is a perspective view of an impeller shown in FIG. 1.

A centrifugal fan 1 according to the illustrative embodiment of the present invention includes an impeller 7 having a plurality of blades 11, and a scroll casing 2 which houses the impeller 7. The scroll casing 2 is configured by an upper casing 3 and a lower casing 4. The impeller 7 is rotated by a motor 8 attached to the lower casing 4. According to the rotation of the impeller 7, air suctioned from a suction opening 5 formed at the upper casing 3 is discharged from a discharge opening 6. The suction opening 5 is an opening formed almost at the center of the upper casing 3, and does not have a bell-mouth shape at the periphery of the opening.

In the impeller 7, the plurality of blades 11 are disposed at an equal interval in a circumferential direction. The ends of the blades 11 on one side are supported by a main plate 9, and the ends of the blades 11 on the other side are supported by an annular shroud 10. That is, the blades 11 are interposed between the main plate 9 and the shroud 10. The annular shroud 10 has a curved surface which is curved in a predetermined shape from an outer edge portion toward a center thereof. A plurality of annular protrusion portions (ribs) 12 are integrally formed on an outer surface of the shroud 10 so as to stand thereon (in FIG. 3, three annular protrusion portions 12). The annular protrusion portions 12 are concentrically formed with the same pitch in a radial direction, and a gap d is formed between the upper casing 3 and each of the protrusion portions 12. Since the distance between each of the protrusion portions 12 and the surface of the lower casing 4 is constant, all of the gaps d between respective annular protrusion portions 12 and the upper casing 3 have the same dimension. However, it is noted that the gap d between each of the protrusion portions 12 and the upper casing 3 may be different from each other. The main plate 9 has a disk-shape, and includes a cup-shaped boss part 9*a* at the center thereof. The blades 11 are backward inclined blades and have a curved shape with a predetermined curvature and inclined backward in a rotation direction of the motor 8 and all have a same shape. A rotor part of the motor 8 is coupled to the inside of the cup-shaped boss part 9*a*, and the impeller 7 rotates according to the rotation of the rotor part. Since the blades 11 are backward inclined blades in the rotation direction of the motor 8, the centrifugal fan 1 is kind of a turbofan.

Figure 4:
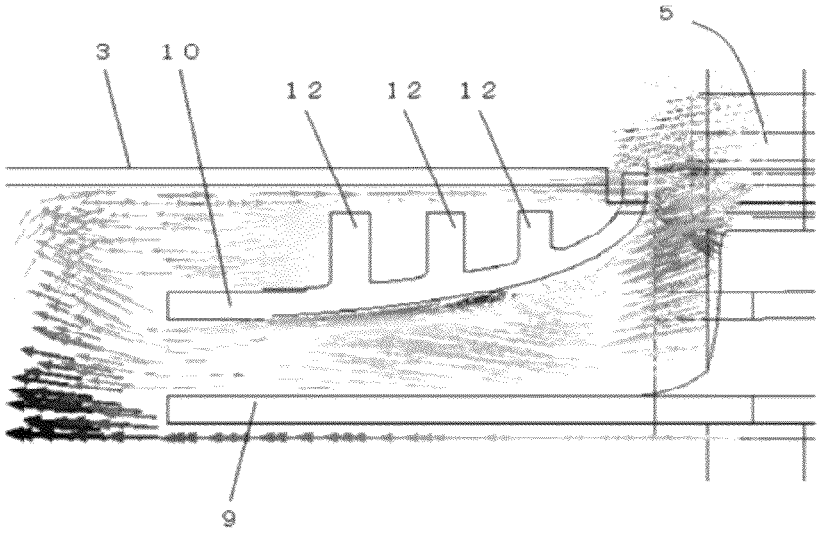
FIG. 4 is a view illustrating a simulation result of an air flow in the centrifugal fan according to an illustrative embodiment of the present invention.
Figure 5:
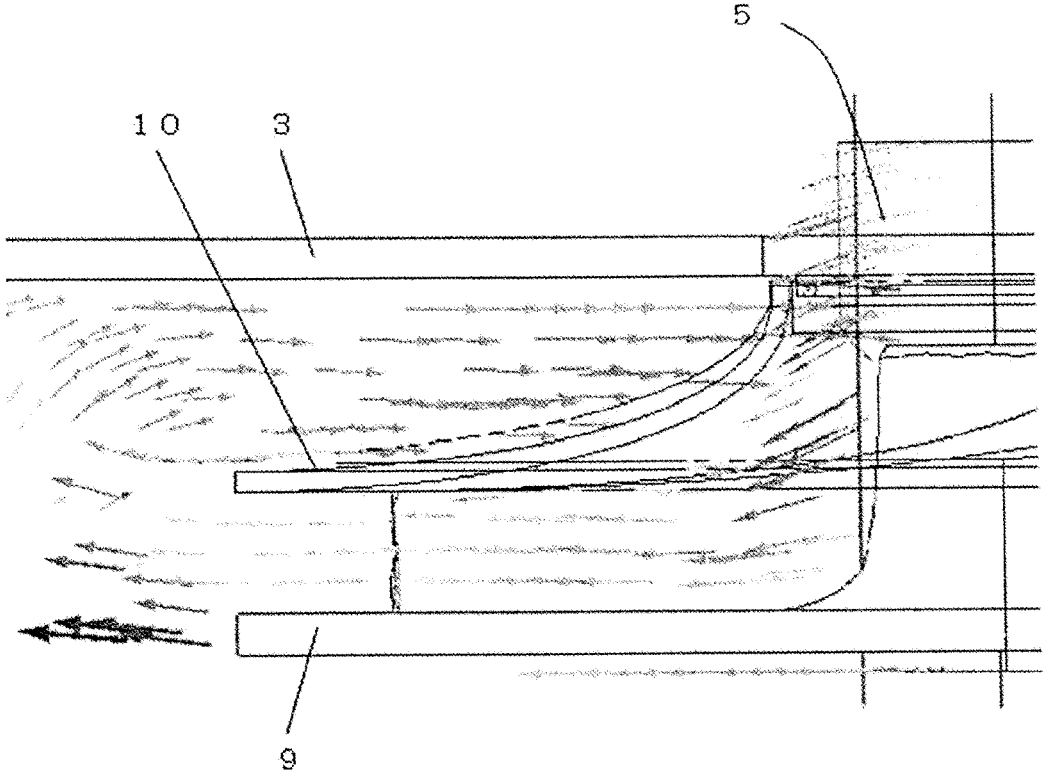
FIG. 5 is a view illustrating a simulation result of an air flow in a related-art centrifugal fan.

FIG. 4 is a view illustrating a simulation result of an air flow in the centrifugal fan 1 according to the illustrative embodiment shown in FIG. 1 on the basis of a finite volume method, and FIG. 5 is a view illustrating a simulation result of an air flow in a related-art centrifugal fan on the basis of a finite volume method.

The related-art centrifugal fan is same as the centrifugal fan according to the illustrative embodiment shown in FIG. 1 except that the related-art centrifugal fan does not have a plurality of protrusion portions at a shroud of an impeller.

FIGS. 4 and 5 show the simulation results of the air flows when a static pressure is 750 Pa.

As shown in FIG. 5, in the related-art centrifugal fan which does not have the plurality of protrusion portions 12 formed on the shroud 10, air suctioned from the suction opening 5 according to the rotation of the impeller is suctioned into the gaps between the blades 11 of the impeller, and then is discharged from the outer edge of the impeller outward in the radial direction. Then, the air discharged from the outer edge of the impeller outward in the radial direction collides with an inner wall of the casing 2, and a portion of the collided air flows between the shroud 10 and the upper casing 3, and flows back to the suction opening 5. This flowing back air interferes with air suctioned into the suction opening 5 while collides with the suctioned air. Therefore, disturbance occurs in the air in the vicinity of the suction opening such that fluid noise is generated and air which is suctioned into the suction opening is largely reduced. As a result, the air flow is largely reduced.

In contrast, in the centrifugal fan 1 according to the illustrative embodiment of the present invention, as shown in FIG. 4, air suctioned from the suction opening 5 according to the rotation of the impeller 7 is suctioned into the gaps between the blades 11 of the impeller 7, and then is discharged from the outer edge of the impeller 7 outward in the radial direction. As shown in FIG. 4, a very small portion of the air discharged from the outer edge of the impeller 7 outward in the radial direction flows between the shroud 10 and the upper casing 3, and flows back to the suction opening 5. That is, it can be seen that the amount of air flowing back is very small, as compared to the related-art centrifugal fan shown in FIG. 5. This is because the plurality of protrusion portions 12 formed on the shroud 10 oppose the upper casing 3 with the gaps d provided therebetween, so that resistance when the air passing through the gaps d increases so as to suppress the air from flowing back. As described above, since the air is largely suppressed from flowing back to the suction opening 5, disturbance does not occur in the air in the vicinity of the suction opening 5. Therefore, it is possible to reduce noise, and air suctioned into the suction opening is not inhibited. As a result, it is possible to largely improve the air flow characteristic.

Further, it is not necessary to dispose the annular protrusions 226*b* of the shroud 226 inside the bell mouth 231 formed at the suction opening, unlike the centrifugal fan disclosed in JP-B-2940751. Therefore, high accuracy is not necessarily required in components and assembly. Therefore, it is possible to reduce the cost of the components, and accordingly, reduce the cost of the centrifugal fan.

Furthermore, in the centrifugal fan according to the illustrative embodiment of the present invention, a bell mouth is not formed at the suction opening. Therefore, it is possible to reduce the dimension of the height of the casing, and thus to reduce the thickness of the centrifugal fan.

Moreover, the plurality of protrusion portions 12 is formed integrally with the outer surface of the shroud 10 to stand. Therefore, it is possible to improve the rigidity of the shroud 10.

Figure 6:
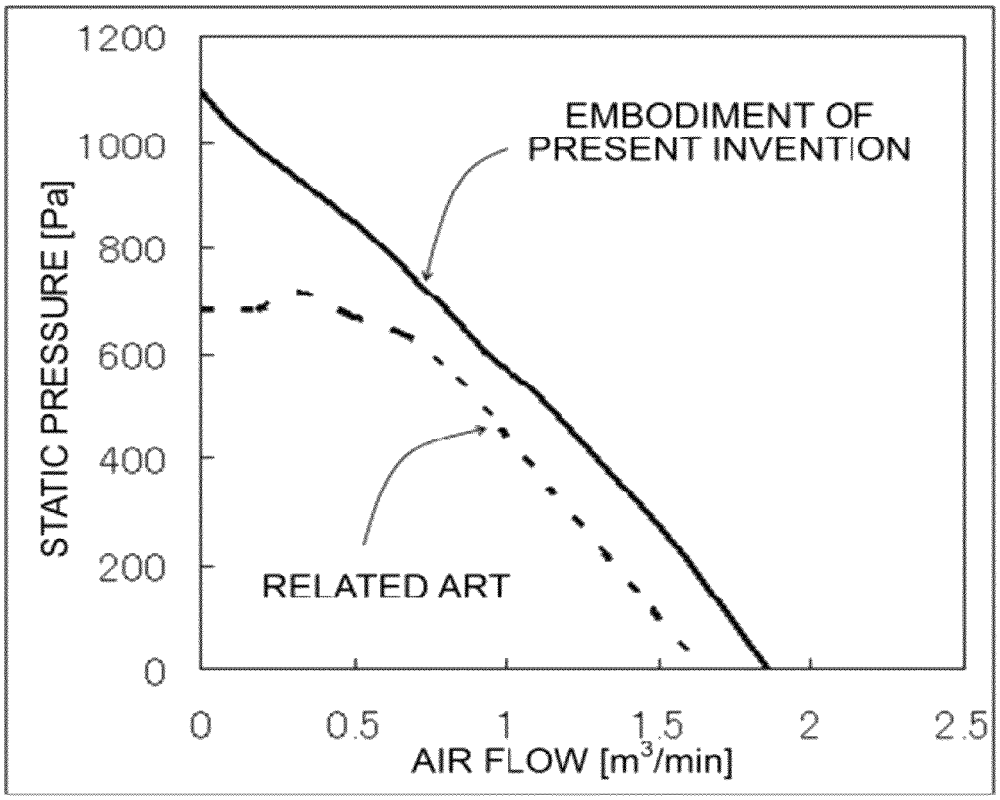
FIG. 6 is a view illustrating a static pressure-air flow characteristic in the centrifugal fan according to an illustrative embodiment of the present invention and a related-art centrifugal fan.

FIG. 6 is a view illustrating a static pressure-air flow characteristic in the centrifugal fan 1 according to the illustrative embodiment of the present invention and the related-art centrifugal fan. As shown in FIG. 6, the centrifugal fan according to the illustrative embodiment of the present invention having the plurality of protrusion portions 12 on the shroud 10 shows larger values in both of the maximum static pressure and the maximum air flow, and has largely improved static pressure-air flow characteristic, as compared to the related-art centrifugal fan. This is because the centrifugal fan according to the illustrative embodiment of the present invention largely suppresses air from flowing back to the suction opening 5, as compared to the related-art centrifugal fan, so that air which is suctioned into suction opening 5 is not inhibited so as to largely improve the air flow characteristic.

As the result obtained by measuring noise of each of the centrifugal fan 1 according to the illustrative embodiment of the present invention and the related-art centrifugal fan on the basis of JIS B8340, the related-art centrifugal fan shows 61.0 dB(A), whereas the centrifugal fan according to the illustrative embodiment of the present invention shows 58.9 dB(A). Consequently, the noise of the centrifugal fan in the present invention can be reduced, as compared to the related-art centrifugal fan.

Figure 7:
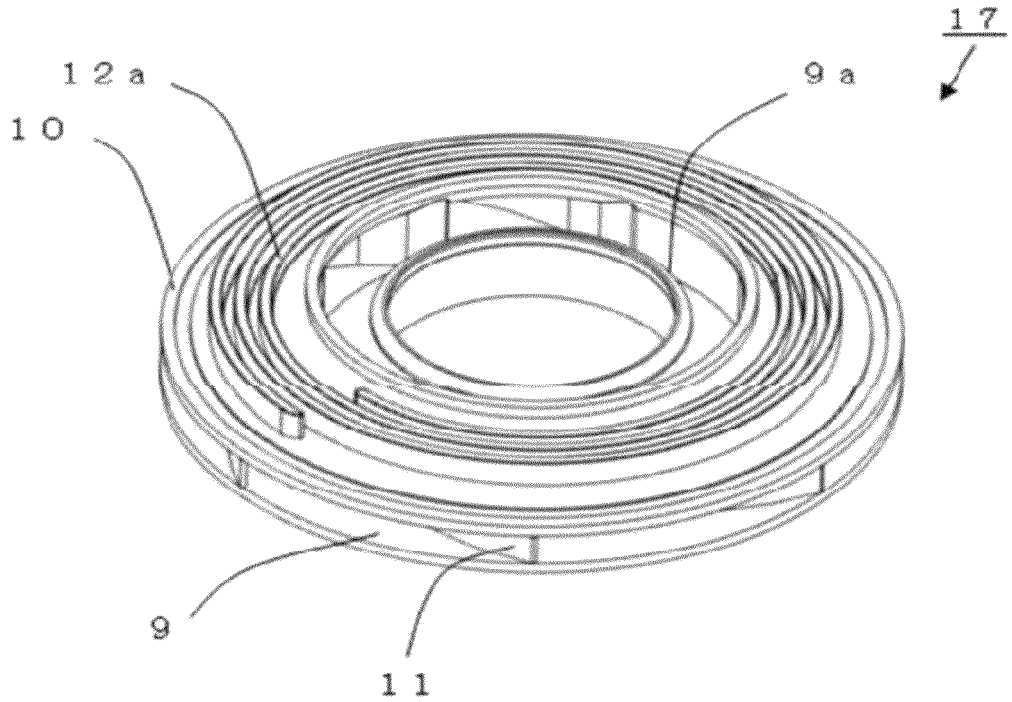
FIG. 7 is a perspective view illustrating an impeller of a centrifugal fan according to another illustrative embodiment of the present invention.

In the above-described illustrative embodiment, the plurality of protrusion portions 12 formed on the shroud 10 of the impeller 7 are concentric and annular. However, the present invention is not limited thereto. As shown in FIG. 7, an impeller 17 may have a shroud 10 formed with a spiral and annular protrusion portion 12*a*. Even in a case of using the impeller 17 having the spiral protrusion portion 12*a* formed with the same pitch, it is possible to largely suppress air from flowing back to the suction opening 5 of the casing 2. Consequently, it is possible to improve the air flow characteristic while reducing fluid noise, and thus the industrial value is high.

Figure 8:
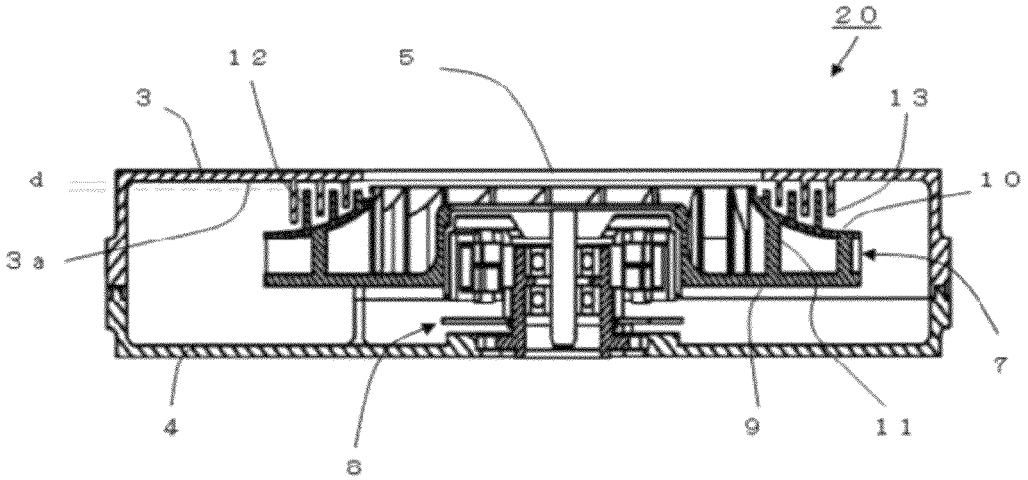
FIG. 8 is a cross-sectional view illustrating a centrifugal fan according to another illustrative embodiment of the present invention.

FIG. 8 is a view illustrating a centrifugal fan according to another illustrative embodiment of the present invention. A centrifugal fan 20 shown in FIG. 8 is different from the centrifugal fan 1 shown in FIG. 2 in that a plurality of concentric and annular protrusions 13 are formed on the inner wall 3*a* of the upper casing 3. That is, the concentric and annular protrusion portions 12 formed on the shroud 10 and the concentric and annular protrusions 13 formed on the inner wall 3*a* of the upper casing 3 may be alternately arranged in the radial direction of the impeller 7. In this configuration, the gaps d are formed between the protrusion portions 12 formed on the shroud 10 and the inner wall 3*a* of the upper casing 3. Therefore, it is not necessarily required to position the protrusion portions 12 and the annular protrusions 13 in the radial direction with high accuracy. In this case, since the protrusion portions 12 formed on the shroud 10 and the annular protrusions 13 formed on the inner wall 3*a* of the upper casing 3 are alternately arranged in the radial direction, a flow path from the outer edge of the impeller 7 to the suction opening 5 becomes longer, as compared to the illustrative embodiment shown in FIG. 2. Therefore, air flowing back to the suction opening 5 can be further reduced.

Figure 9:
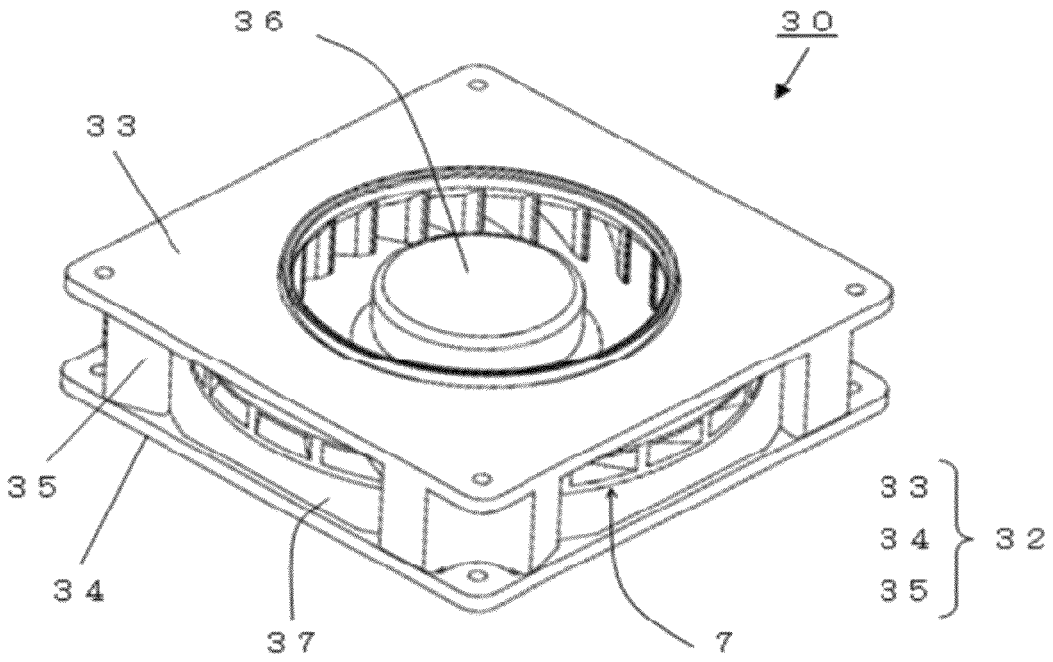
FIG. 9 is a perspective view illustrating a centrifugal fan according to another illustrative embodiment of the present invention.
Figure 10:
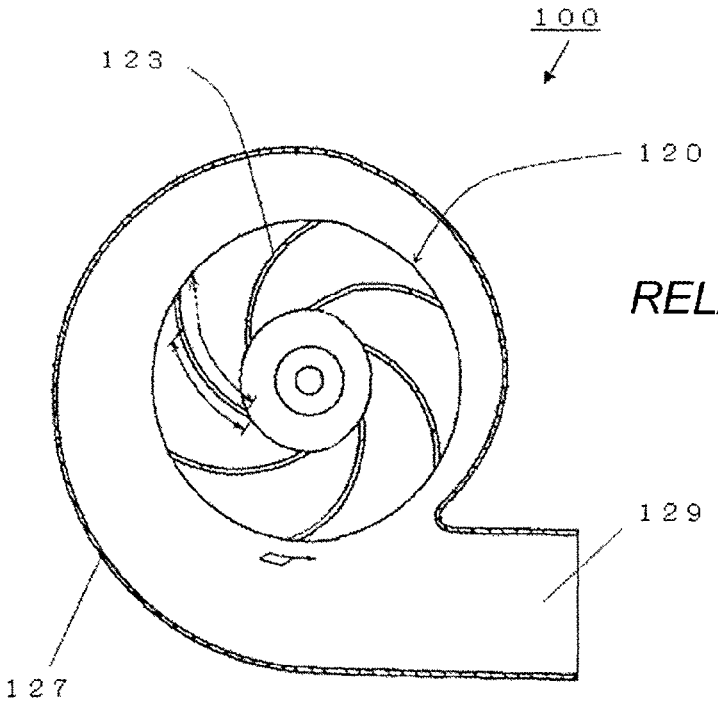
FIG. 10 is a cross-sectional view illustrating a related-art centrifugal fan.
Figure 11:
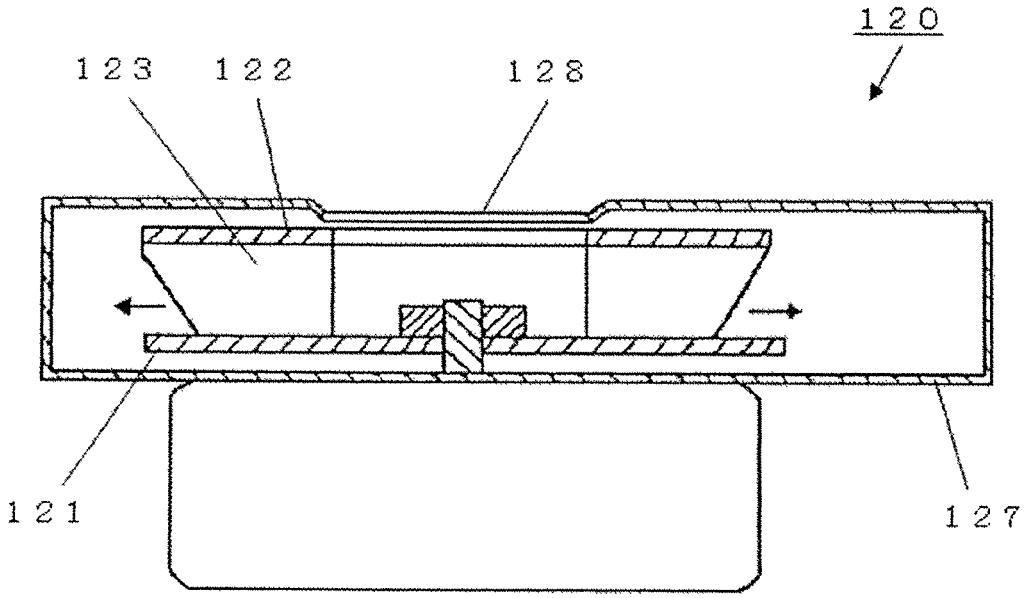
RELATED ART FIG.11
FIG. 11 is a planar cross-sectional view of the related-art centrifugal fan shown in FIG. 10.
Figure 12:
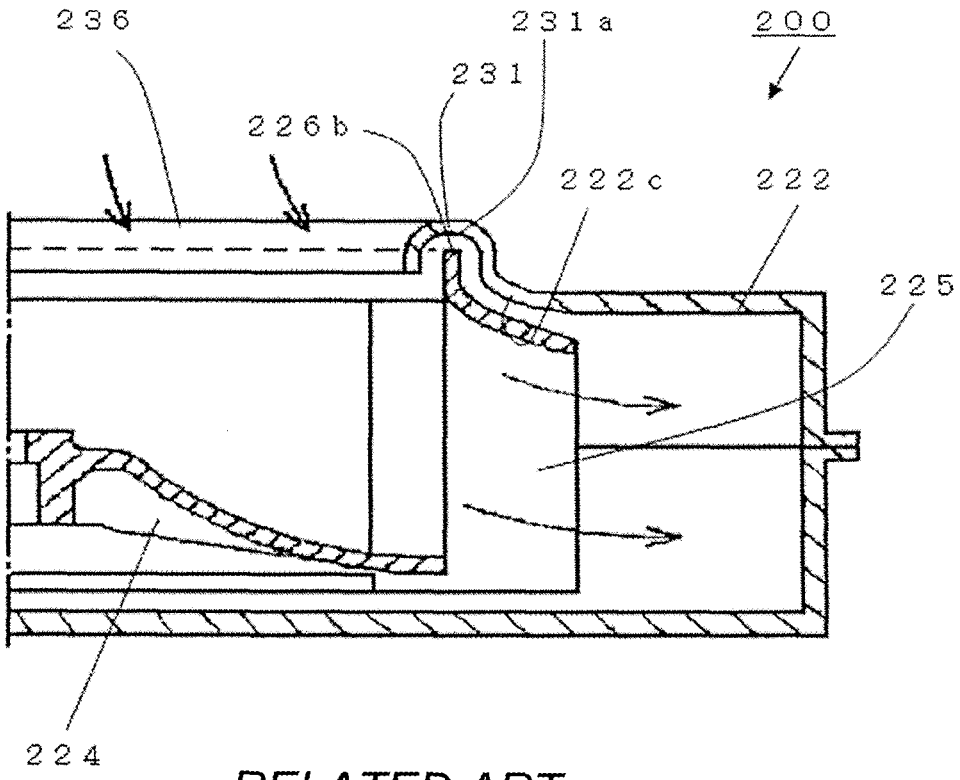
FIG. 12 is a cross-sectional view of a portion of another related-art centrifugal fan.

Also, the above-described centrifugal fan 1 includes the scroll casing 2. However, the present invention is not limited thereto. As shown in FIG. 9, a centrifugal fan 30 may include a casing 32 including an upper plate 33 configuring an upper casing, a lower plate 34 configuring a lower casing, and a plurality of supporting columns 35 interposed therebetween. This casing 32 has openings formed at all of the sides and configuring discharge openings 37. In a case where the impeller 7 shown in FIG. 3 is used and the gaps d are formed between the upper plate 33 of the casing 32 and the protrusion portions 12, air flowing back to a suction opening 36 can be reduced.

What is claimed is:

1. A centrifugal fan configured such that an impeller, having a plurality of blades along a circumferential direction and disposed between a disk-shaped main plate and an annular shroud, is housed in a casing configured by an upper casing and a lower casing, and that an air suctioned from a suction opening is discharged outward in a radial direction of the impeller by a centrifugal force due to a rotation of the impeller, wherein the shroud has a curved surface formed from an outer edge portion toward a center thereof, wherein the shroud has a plurality of protrusion portions thereon which are formed annularly and spirally on the curved surface of the shroud and arranged such that a gap is formed between each of the protrusion portions and the upper casing, and wherein a lower surface of the upper casing is faced to the top end of the protrusion portions such that each of the gaps therebetween are the same.

2. A centrifugal fan configured such that an impeller, having a plurality of blades along a circumferential direction and disposed between a disk-shaped main plate and an annular shroud, is housed in a casing configured by an upper casing and a lower casing, and that an air suctioned from a suction opening is discharged outward in a radial direction of the impeller by a centrifugal force due to a rotation of the impeller, wherein the shroud has a curved surface formed from an outer edge portion toward a center thereof, wherein the shroud has at least one protrusion portion formed annularly and spirally on the curved surface of the shroud and arranged such that a gap is formed between said at least one protrusion portion and the upper casing, and wherein a lower surface of the upper casing is faced toward the top end of said at least one protrusion portion to have said gap therebetween.

* * * * *